US011450496B2

(12) United States Patent
Harimochi et al.

(10) Patent No.: US 11,450,496 B2
(45) Date of Patent: Sep. 20, 2022

(54) RELAY

(71) Applicant: OMRON Corporation, Kyoto (JP)

(72) Inventors: Hiroyuki Harimochi, Kumamoto (JP); Ryota Minowa, Yamaga (JP); Naoki Kawaguchi, Yame (JP); Shinichi Ogawa, Kikuchi (JP); Kohei Otsuka, Omuta (JP); Hiroyuki Iwasaka, Kumamoto (JP); Kazuhiro Tsutsui, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 140 days.

(21) Appl. No.: 17/012,065

(22) Filed: Sep. 4, 2020

(65) Prior Publication Data

US 2021/0082647 A1 Mar. 18, 2021

(30) Foreign Application Priority Data

Sep. 13, 2019 (JP) ..... JP2019-167371

(51) Int. Cl.

| | |
|---|---|
| ***H01H 3/00*** | (2006.01) |
| ***H01H 50/02*** | (2006.01) |
| ***H01H 50/20*** | (2006.01) |
| ***H01H 50/42*** | (2006.01) |
| *H01H 50/54* | (2006.01) |

(52) U.S. Cl.

CPC ..... *H01H 50/02* (2013.01); *H01H 50/20* (2013.01); *H01H 50/42* (2013.01); *H01H 50/546* (2013.01)

(58) Field of Classification Search

CPC ..... H01H 50/02; H01H 50/20; H01H 50/42; H01H 50/546; H01H 1/34; H01H 9/443; H01H 50/045; H01H 51/06; H01H 50/04; H01H 50/54; H01H 50/60

USPC ..... 335/185

See application file for complete search history.

(56) References Cited

U.S. PATENT DOCUMENTS 5,227,751 A * 7/1993 Shiroyama ..... H01H 51/065 335/131

5,420,555 A * 5/1995 Toguchi ..... H01H 13/063 200/243

(Continued)

FOREIGN PATENT DOCUMENTS

JP 2013-187134 A 9/2013

JP 2014-110094 A 6/2014

*Primary Examiner* — Shawki S Ismail

*Assistant Examiner* — Lisa N Homza

(74) *Attorney, Agent, or Firm* — Shinjyu Global IP

(57) ABSTRACT

A relay includes a fixed terminal, a movable contact piece, a holder, a drive shaft, a contact case, a magnetic field generation member, and an inner member. The drive shaft is connected to the holder on a side close to the first end of the drive shaft. The magnetic field generation member is arranged around the contact case and is configured to generate a magnetic field in which an arc generated between the fixed contact and the movable contact extends in a lateral direction of the movable contact piece. The inner member includes a rotation preventing portion for restricting rotation of the holder around the drive shaft. The rotation preventing portion is arranged so as to contact the holder at a position closer to a second end of the drive shaft than the movable contact piece and closer to the drive shaft than the movable contact.

8 Claims, 6 Drawing Sheets

(56) References Cited

U.S. PATENT DOCUMENTS 5,892,194 A * 4/1999 Uotome ..... H01H 51/065 335/154
2004/0027776 A1* 2/2004 Uotome ..... H01H 51/28 361/160
2009/0066450 A1* 3/2009 Yano ..... H01H 49/00 335/203
2013/0012037 A1* 1/2013 Enomoto ..... H01H 50/546 439/39
2013/0057377 A1* 3/2013 Yano ..... H01H 51/06 336/192
2013/0063232 A1* 3/2013 Takaya ..... H01H 50/546 335/201
2013/0127571 A1* 5/2013 Takaya ..... H01H 50/546 335/201
2013/0214884 A1* 8/2013 Ito ..... H01H 50/546 335/154
2013/0234811 A1 9/2013 Nishimura
2013/0240495 A1* 9/2013 Yano ..... H01H 9/36 219/123
2014/0184366 A1* 7/2014 Ito ..... H01H 50/546 335/189
2015/0022291 A1* 1/2015 Kashimura ..... H01H 3/28 218/148
2015/0123753 A1* 5/2015 Kawaguchi ..... H01H 50/20 335/203
2015/0194284 A1* 7/2015 Uruma ..... H01H 50/64 335/179
2016/0233039 A1* 8/2016 Kanematsu ..... H01H 50/54
2016/0260563 A1* 9/2016 Shima ..... H01H 9/443
2017/0069452 A1* 3/2017 Hiroki ..... H01H 50/546
2017/0365431 A1* 12/2017 Sakai ..... H01H 50/42
2017/0365432 A1* 12/2017 Sakai ..... H01H 50/20
2018/0061599 A1* 3/2018 Enomoto ..... H01H 50/08
2019/0013171 A1* 1/2019 Minowa ..... H01H 50/44
2019/0035585 A1* 1/2019 Minowa ..... H01H 50/42
2019/0122844 A1* 4/2019 Minowa ..... H01H 50/02
2019/0131093 A1* 5/2019 Minowa ..... H01H 50/02
2019/0131094 A1* 5/2019 Minowa ..... H01H 50/045
2019/0131095 A1* 5/2019 Minowa ..... H01H 50/546
2019/0131097 A1* 5/2019 Minowa ..... H01H 50/04
2019/0148095 A1* 5/2019 Minowa ..... H01H 50/42 335/185

* cited by examiner

RELAY

CROSS-REFERENCE TO RELATED APPLICATION

This application claims priority to Japanese Patent Application No. 2019-167371, filed Sep. 13, 2019. The contents of that application are incorporated by reference herein in their entirety.

FIELD

The present invention relates to a relay.

BACKGROUND

A plunger-type relay is known as a relay that opens and closes an electric circuit. In the plunger type relay, when a movable contact piece moves in a direction in which the movable contact piece comes into contact with a fixed contact or a direction in which the movable contact piece separates from the fixed contact, the movable is likely to rotate around the axis of a drive shaft. For this reason, for example, in Japanese Laid-Open Patent Publication No. 2013-187134, a contact case is provided with a rotation preventing portion for restricting rotation of the movable contact piece around the drive shaft.

SUMMARY

The contact case is provided with a space for extending an arc generated between the fixed contact and the movable contact. For example, in Japanese Laid-Open Patent Publication No. 2014-110094, a pair of magnets is arranged so that different poles face each other in the longitudinal direction of the movable contact piece, and a Lorentz force acts on the arc and the arc is extended in the lateral direction of the movable contact piece.

In Japanese Laid-Open Patent Publication No. 2013-187134, since the rotation preventing portion is provided so as to project from the inner wall of the contact case in order to ensure a sufficient space for extending the arc, the size of the contact case is likely to increase. In particular, in recent years, miniaturization of relays has been demanded, and in order to facilitate miniaturization of the contact case, it is necessary to efficiently secure a space for extending the arc.

An object of the present invention is to provide a relay capable of efficiently securing a space for extending an arc.

A relay according to one aspect of the present invention includes a fixed terminal, a movable contact piece, a holder, a drive shaft, a contact case, a magnetic field generation member, and an inner member. The fixed terminal includes a fixed contact. The movable contact piece includes a movable contact arranged to face the fixed contact. The movable contact piece is configured to move in a moving direction including a first direction in which the movable contact comes into contact with the fixed contact and a second direction in which the movable contact separates from the fixed contact. The holder holds the movable contact piece. The drive shaft includes a first end and a second end opposite to the first end. The drive shaft extends in the moving direction of the movable contact piece and is connected to the holder on a side close to the first end of the drive shaft. The contact case accommodates the fixed contact, the movable contact piece, and the holder. The magnetic field generation member is configured to generate a magnetic field in which an arc generated between the fixed contact and the movable contact extends in a lateral direction of the movable contact piece. The inner member is a separate body from the contact case. The inner member includes a rotation preventing portion for restricting rotation of the holder around the drive shaft. The rotation preventing portion is arranged so as to contact the holder at a position closer to the second end of the drive shaft than the movable contact piece and closer to the drive shaft than the movable contact.

In this relay, the rotation preventing portion is arranged so as to contact the holder at a position closer to the second end of the drive shaft than the movable contact piece and closer to the drive shaft than the movable contact. Accordingly, the space for extending the arc can be secured on the second end side of the drive shaft in the movable contact piece, so that the space for extending the arc can be efficiently secured. As a result, the relay can be easily downsized. Further, the contact case can be more easily downsized as compared with the case where the rotation preventing portion is provided so as to project from the inner wall of the contact case. Further, since the rotation preventing portion is provided on the inner member that is a separate body from the contact case, the degree of freedom of arrangement within the contact case is improved.

The contact case may has an opening that toward the second end of the drive shaft. The inner member may further include a base portion arranged to cover the opening of the contact case. The rotation preventing portion may project from the base portion toward the movable contact piece. In this case, since the inner member is arranged so as to cover the opening, the space for extending the arc can be formed by the inner member and the case member. Further, the rotation preventing portion can be easily formed.

The inner member may further include a tubular portion that extends from the base portion in the moving direction and into which the drive shaft is inserted. In this case, the drive shaft can be supported by the tubular portion, and the movement of the drive shaft can be guided by the tubular portion.

The holder may include a plurality of contact portions configured to contact the rotation preventing portion. The plurality of contact portions may be arranged to face the rotation preventing portion in a longitudinal direction of the movable contact piece. In this case, the rotation angle of the holder around the drive axis can be effectively suppressed by the rotation preventing portion.

The plurality of contact portions and the rotation preventing portion may extend parallel to the lateral direction of the movable contact piece. Even in this case, the rotation angle of the holder around the drive axis can be effectively suppressed by the rotation preventing portion.

The plurality of contact portions may be arranged without overlapping the movable contact piece in the moving direction of the movable contact piece. In this case, the rotation angle of the holder around the drive axis can be more effectively suppressed by the rotation preventing portion.

The holder may include a pedestal portion on which the movable contact piece is placed, a leg portion extending from both ends of the pedestal portion in the lateral direction of the movable contact piece toward the second end of the drive shaft, and a part of clamping portions clamping the movable contact piece. The pair of clamping portions may be formed by bending a part of the leg portion toward the first end of the drive shaft. In this case, the movable contact piece can be held by the holder with a simple structure.

At least a part of the inner member may be formed of an insulating material. In this case, a breaking performance can be improved by the inner member.

The plurality of contact portions and the rotation preventing portion are made of a metal member. In this case, for example, it is possible to prevent the rotation preventing portion from being scraped as compared with the case where the rotation preventing portion is formed of resin.

DETAILED DESCRIPTION

Figure 1:
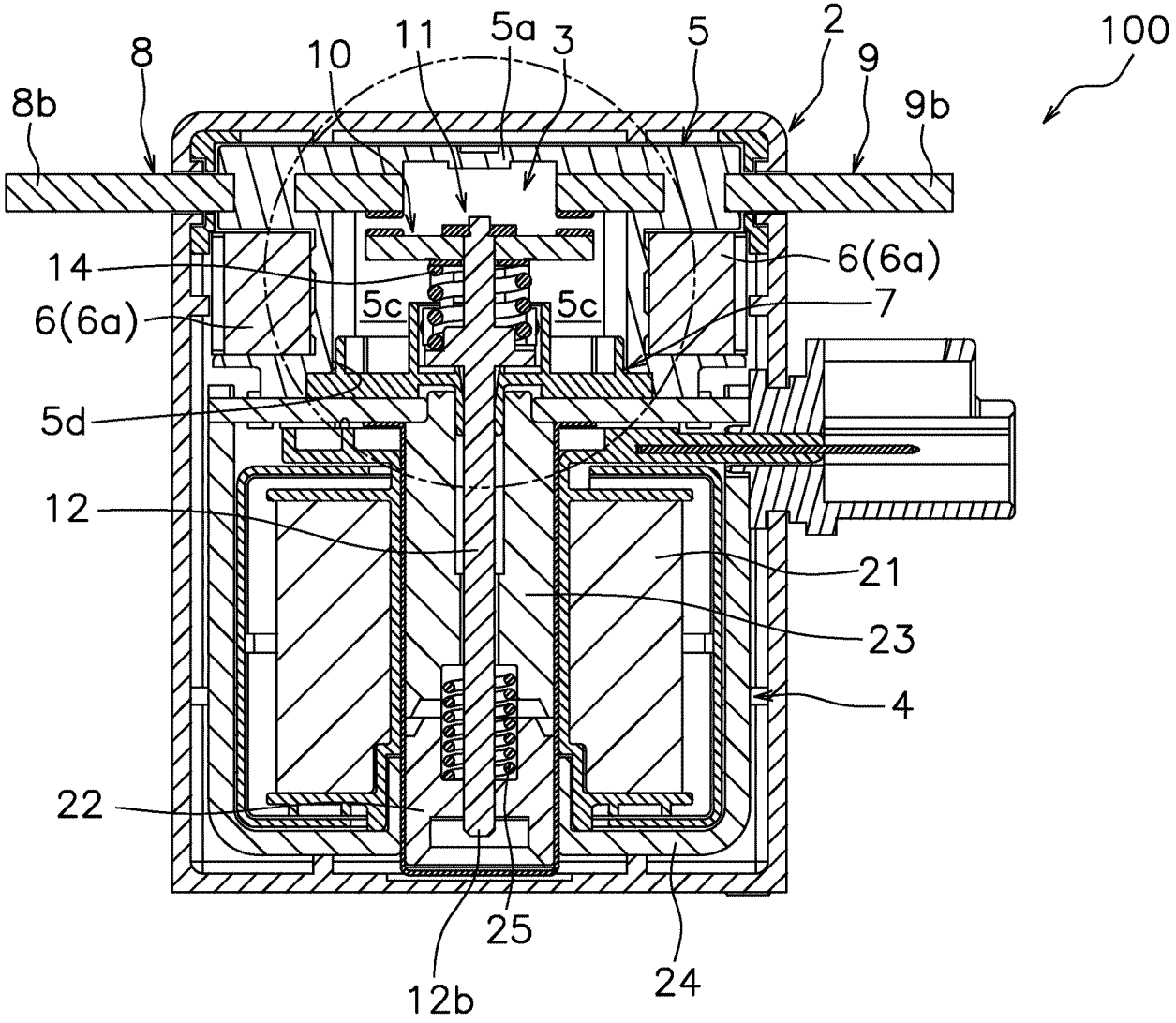
FIG. 1 is a longitudinal sectional view of a relay.

Hereinafter, embodiment of a relay 100 according to one aspect of the present invention will be described with reference to the drawings. When referring to the drawings, an upper side in FIG. 1 is referred to as "up", a lower side is referred to as "down", a left side is referred to as "left", and a right side is referred to as "right" in order to facilitate understanding of the description. In addition, a direction orthogonal to the paper surface of FIG. 1 will be described as a front-back direction. These directions are defined for convenience of explanation, and do not limit an arrangement direction of the relay 100.

The relay 100 includes a housing 2, a contact device 3, a drive device 4, a contact case 5, a magnetic field generation member 6, and an inner member 7.

The housing 2 has a substantially rectangular box shape and is made of an insulating material. The contact device 3, the drive device 4, the contact case 5, and the inner member are housed inside the housing 2.

The contact device 3 includes a first fixed terminal 8, a second fixed terminal 9, a movable contact piece 10, and a movable mechanism 11.

The first fixed terminal 8 and the second fixed terminal 9 are plate-shaped terminals and extend in the left-right direction. The first fixed terminal 8 and the second fixed terminal 9 extend both inside and outside the housing 2. The first fixed terminal 8 and the second fixed terminal 9 are arranged apart from in the left-right direction. The first fixed terminal 8 and the second fixed terminal 9 are made of a conductive material.

The first fixed terminal 8 includes a first fixed contact 8*a* and a first external connection portion 8*b*. The first fixed contact 8*a* is arranged inside the housing 2. The first external connection portion 8*b* projects leftward from the housing 2. The first fixed contact 8*a* is provided separately from the first fixed terminal 8. The first fixed contact 8*a* may be integrated with the first fixed terminal 8.

The second fixed terminal 9 includes a second fixed contact 9*a* and a second external connection portion 9*b*. The second fixed contact 9*a* is arranged inside the housing 2. The second external connection portion 9*b* projects rightward from the housing 2. The second fixed contact 9*a* is provided separately from the second fixed terminal 9. The second fixed contact 9*a* may be integrated with the second fixed terminal 9. Note that, below, the first fixed contact 8*a* and the second fixed contact 9*a* may be described as the fixed contacts 8*a*, 9*a*.

The movable contact piece 10 is a plate shape member that is long in one direction, and extends in the left-right direction inside the housing 2. The movable contact piece 10 is made of a conductive material. A longitudinal direction of the movable contact piece 10 matches the left-right direction. Moreover, a lateral direction of the movable contact piece 10 matches the front-back direction.

The movable contact piece 10 includes a first movable contact 10*a* and a second movable contact 10*b*. The first movable contact 10*a* is arranged at a position facing the first fixed contact 8*a* and can contact the first fixed contact 8*a*. The second movable contact 10*b* is arranged at a position facing the second fixed contact 9*a* and can contact the second fixed contact 9*a*. The first movable contact 10*a* and the second movable contact 10*b* are provided separately from the movable contact piece 10. Note that, the movable contacts 10*a*, 10*b* may be integrated with the movable contact piece 10. Note that, below, the first movable contact 10*a* and the second movable contact 10*b* may be described as the movable contacts 10*a*, 10*b*.

The movable contact piece 10 is configured to move in a moving direction including a contact direction in which the movable contacts 10*a*, 10*b* come into contact with the fixed contacts 8*a*, 9*a* and a separation direction in which the movable contacts 10*a*, 10*b* are separated from the fixed contacts 8*a*, 9*a*. The contact direction is a direction in which the movable contact piece 10 approaches the fixed contacts 8*a*, 9*a* (upward in FIG. 1). The separation direction is a direction in which the movable contact piece 10 separates from the fixed contacts 8*a* 9*a* (downward in FIG. 1). Therefore, the contact direction and the separation direction are parallel to the up-down direction.

The movable mechanism 11 includes a drive shaft 12, a retaining member 13, a contact spring 14, and a holder 30. The drive shaft 12 extends in the moving direction of the movable contact piece 10. That is, the drive shaft 12 extends in the up-down direction. The drive shaft 12 includes a first end 12*a*, a second end 12*b*, and a flange portion 12*c*. In the present embodiment, the first end 12*a* is an upper end of the drive shaft 12. The second end 12*b* is an end opposite to the first end 12*a*, and is a lower end of the drive shaft 12. Therefore, in the present embodiment, a first end 12*a* side is the upper side and a second end 12*b* side is the lower side.

Figure 2:
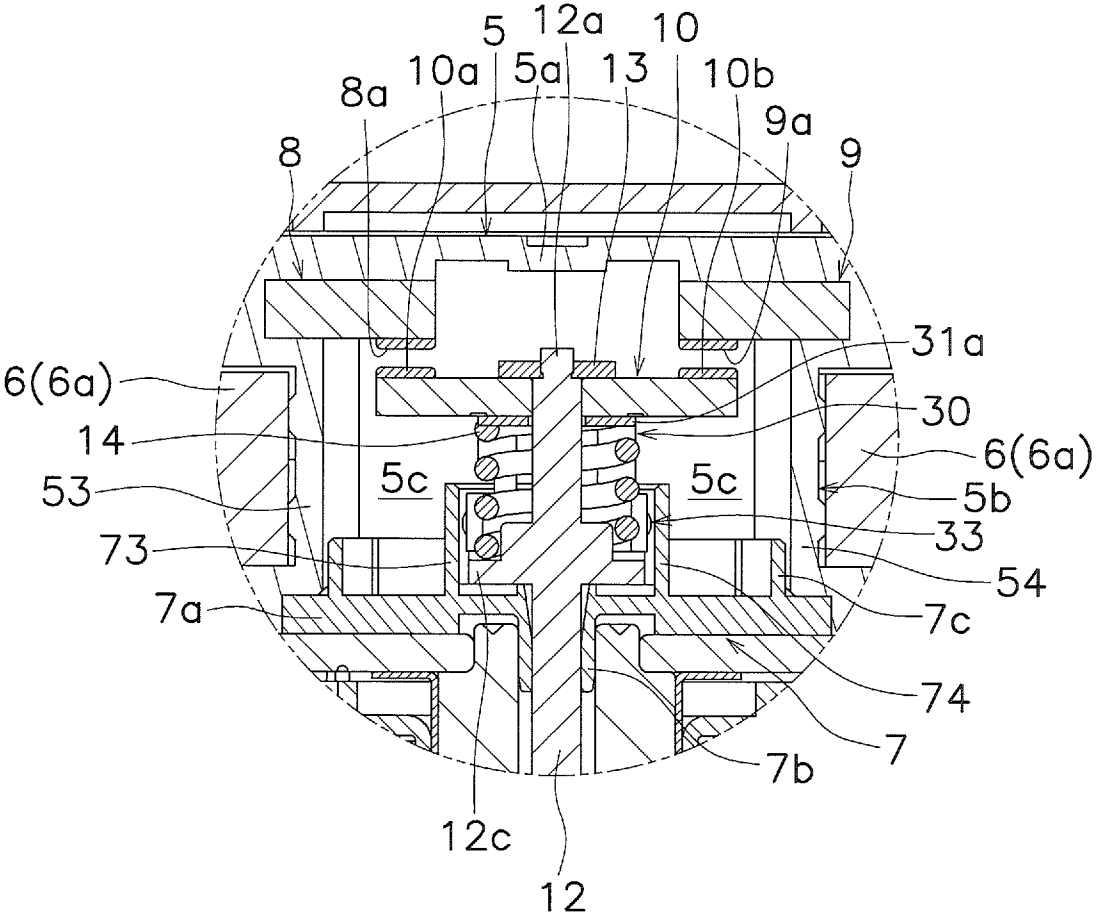
FIG. 2 is an enlarged view of surroundings of a contact device of FIG. 1.

The drive shaft 12 is connected to the holder 30 on the first end 12*a* side. The first end 12*a* penetrates the movable contact piece 10 in the up-down direction and projects upward from the movable contact piece 10. The flange portion 12*c* is arranged between the first end 12*a* and the second end 12*b*. As illustrated in FIG. 2, the flange portion 12*c* is arranged above a described later cylindrical portion 7*b* of the inner member 7.

The retaining member 13 retains the movable contact piece 10 from the drive shaft 12. The retaining member 13 is a ring shape member, and is fixed to the drive shaft 12 on top of the movable contact piece 10. The contact spring 14 is arranged between the flange portion 12*c* of the drive shaft 12 and the holder 30. The contact spring 14 biases the movable contact piece 10 in the contact direction via the holder 30. The holder 30 holds the movable contact piece 10. The holder 30 is rotatable around the drive shaft 12 together with the movable contact piece 10. Details of the holder 30 will be described later.

The drive device 4 moves the movable mechanism 11 in the contact direction and the separating direction by the electromagnetic force. The drive device 4 includes a coil 21, a movable iron core 22, a fixed iron core 23, a yoke 24, and a return spring 25.

When a voltage is applied and the coil 21 is excited, the coil 21 generates the electromagnetic force that moves the movable iron core 22 in the contact direction. The movable iron core 22 is coupled to the drive shaft 12 so as to be integrally movable. The fixed iron core 23 is arranged at a position facing the movable iron core 22. The yoke 24 is arranged so as to surround the coil 21. The return spring 25 is arranged between the movable iron core 22 and the fixed iron core 23. The return spring 25 biases the movable iron core 22 in the separation direction. Since the operation of the relay is the same as the conventional one, detailed description thereof will be omitted. Note that, FIG. 1 shows a state where no voltage is applied to the coil 21.

The contact case 5 is made of an insulating material. The contact case 5 has a box shape and opens toward the second end 12*b* side (downward in FIG. 1). Specifically, the contact case 5 includes a cover portion 5*a* and a wall portion 5*b*.

Figure 3:
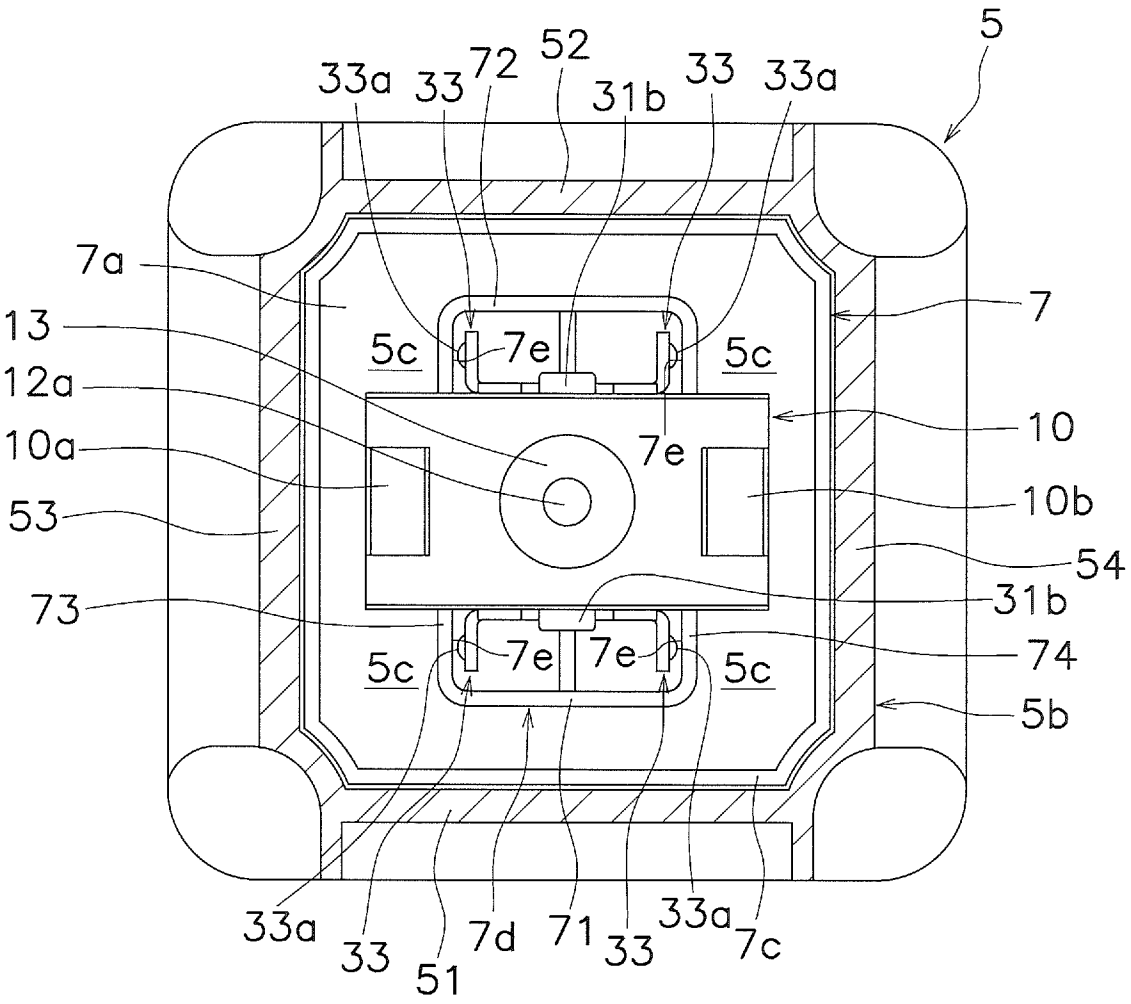
FIG. 3 is a view of the inside of the contact case as viewed from a first end side.

The cover portion 5*a* is arranged above the contact device 3 and covers the contact device 3 from above in the housing 2. The cover portion 5*a* extends in the front-back direction and the up-down direction. As illustrated in FIG. 3, the wall portion 5*b* is formed in a substantially rectangular shape as viewed from the first end 12*a* side, and extends from the cover portion 5*a* to the second end 12*b* side. Specifically, the wall portion 5*b* includes first to fourth wall portions 51 to 54. The first wall portion 51 and the second wall portion 52 are arranged to face each other in the lateral direction of the movable contact piece 10. The third wall portion 53 and the fourth wall portion 54 are arranged to face each other in the longitudinal direction of the movable contact piece 10. A length of the first wall portion 51 and the second wall portion 52 in the left-right direction is equal to a length of the third wall portion 53 and the fourth wall portion 54 in the front-rear direction.

The fixed contacts 8*a* 9*a*, the movable contact piece 10, and the holder 30 are housed in the contact case 5. In the present embodiment, the contact case 5 further accommodates the first end 12*a* of the drive shaft 12, the flange portion 12*c* of the drive shaft 12, and the contact spring 14. As illustrated in FIGS. 1 to 3, an arc extension space 5*c* is provided in the contact case 5 to extend an arc generated between the first fixed contact 8*a* and the first movable contact 10*a* and between the second fixed contact 9*a* and the second movable contact 10*b*. The arc extension space 5*c* is provided so as to extend in the lateral direction of the movable contact piece 10 from the movable contacts 10*a*, 10*b*, and to the second end 12*b* side near both ends of the movable contact piece 10. The arc extension space 5*c* is formed by the contact case 5 and the inner member 7

The magnetic field generation member 6 is arranged around the contact case 5 and generates a magnetic field in which the arc extends in the lateral direction of the movable contact piece 10. The magnetic field generation member 6 includes a pair of permanent magnets 6*a*. The pair of permanent magnets 6*a* is arranged outside the contact case 5 so that different poles face each other in the longitudinal direction of the movable contact piece 10, and generates a magnetic flux in the contact case 5 in the left-right direction. Thereby, for example, when a current flows in the up-down direction between the first fixed contact 8*a* and the first movable contact 10*a*, the Lorentz force from the movable contacts 10*a*, 10*b* toward the first wall portion 51 or the second wall portion 52 acts on the arc. By acting on the arc, the arc is extended in the direction toward the first wall portion 51 or the second wall portion 52. Then, the arc is stretched in the arc extension space 5*c*, and the arc is quickly extinguished.

The inner member 7 is provided separately from the contact case 5. At least a part of the inner member 7 is formed of, for example, an insulating material. In this embodiment, the entire inner member 7 is made of an insulating material. The inner member 7 is arranged inside the contact case 5. The inner member 7 is arranged so as to cover the second end 12*b* side of the contact case 5.

The inner member 7 includes a base portion 7*a*, a tubular portion 7*b*, an outer wall portion 7*c*, an inner wall portion 7*d*, and a rotation preventing portion 7*e*. The base portion 7*a* is formed in a substantially rectangular shape and is arranged to cover an opening 5*d* of the contact case 5. The drive shaft 12 penetrates a center of the base portion 7*a* in the up-down direction. The tubular portion 7*b* extends in the moving direction from the base portion 7*a*, and the drive shaft 12 is inserted therein. Specifically, the tubular portion 7*b*, near the center of the base portion 7*a*, extends from the base portion 7*a* toward the second end 12*b* side. The tubular portion 7*b* supports the drive shaft 12 and guides the up-down movement of the drive shaft 12.

The outer wall portion 7*c* is formed in a substantially rectangular shape as viewed from the first end 12*a* side. The outer wall portion 7*c* extends from the base portion 7*a* to the first end 12*a* side along the wall portion 5*b* of the contact case 5.

The inner wall portion 7*d* is located closer to the drive shaft 12 than the outer wall portion 7*c*. The inner wall portion 7*d* is formed in a substantially rectangular shape as viewed from the first end 12*a* side, and extends from the base portion 7*a* to the first end 12*a* side. The inner wall portion 7*d* is arranged closer to the second end 12*b* side than the movable contact piece 10. The flange portion 12*c* of the drive shaft 12, a part of the contact spring 14 and a part of the holder 30 are housed in the space surrounded by the inner wall portion 7*d*.

Figure 4:
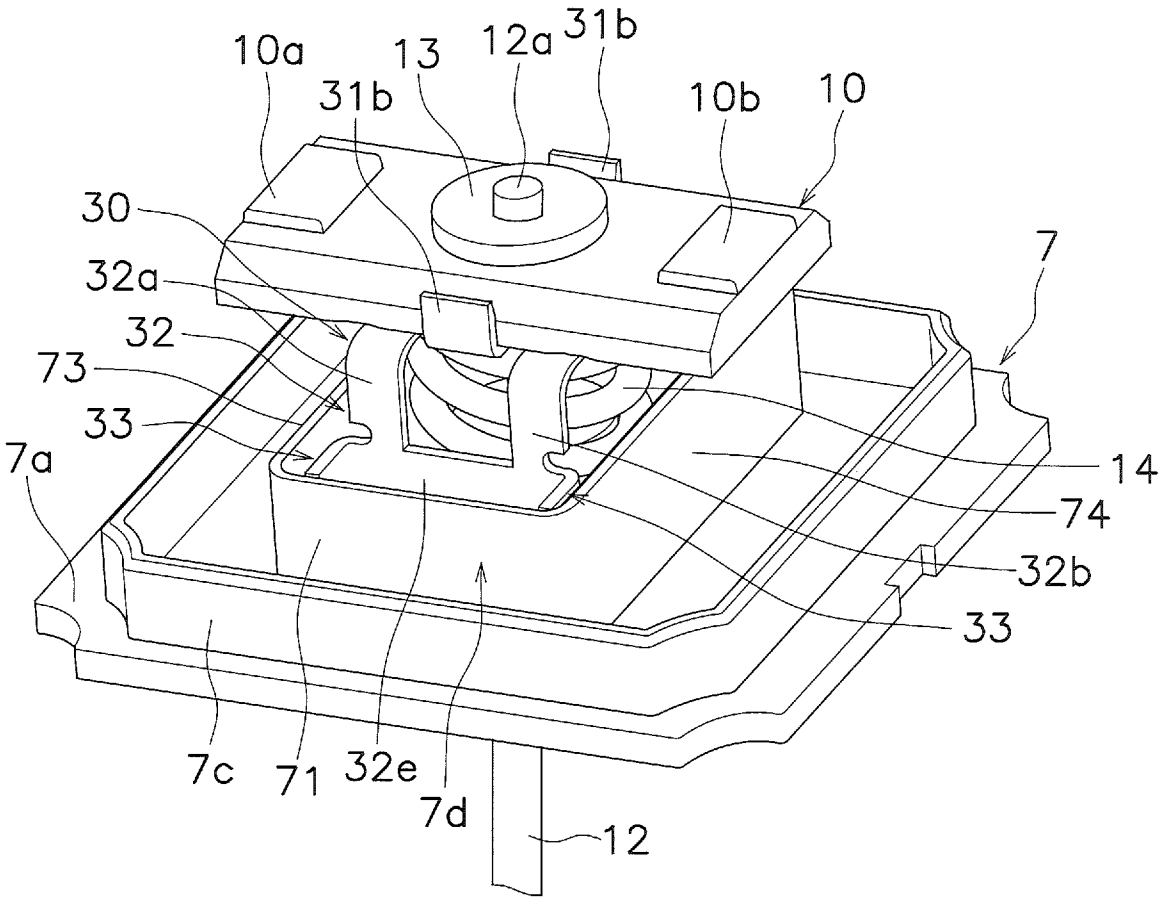
FIG. 4 is a perspective view of the inside of the contact case as viewed from the first end side.

As illustrated in FIGS. 3 and 4, the inner wall portion 7*d* is formed longer in the front-back direction than in the left-right direction. Specifically, the inner wall portion 7*d* includes first to fourth wall portions 71 to 74. The first wall portion 71 and the second wall portion 72 extend in a direction parallel to the longitudinal direction of the movable contact piece 10. That is, the first wall portion 71 and the second wall portion 72 extend in the left-right direction. The first wall portion 71 and the second wall portion 72 are arranged to face each other in the front-back direction. The third wall portion 73 and the fourth wall portion 74 extend parallel to the lateral direction of the movable contact piece 10. That is, the third wall portion 73 and the fourth wall portion 74 extend in the front-back direction. The third wall portion 73 and the fourth wall portion 74 are arranged to face each other in the left-right direction of the movable contact piece 10.

Lengths of the first wall portion 71 and the second wall portion 72 in the left-right direction are shorter than lengths of the third wall portion 73 and the fourth wall portion 74 in the front-back direction. The length of the first wall portion 71 and the second wall portion 72 in the left-right direction are shorter than the length of the movable contact piece 10 in the left-right direction. The length of the third wall portion 73 and the fourth wall portion 74 in the front-back direction are longer than the length of the movable contact piece 10 in the front-back direction.

The first wall portion 71 is arranged between the first wall portion 51 and the movable contact piece 10 as viewed from the first end 12*a* side. The second wall portion 72 is arranged between the second wall portion 52 and the movable contact piece 10 as viewed from the first end 12*a* side. The third wall portion 73 is arranged at a position closer to the drive shaft 12 than the first movable contact 10*a*. That is, the first movable contact 10*a* is arranged between the third wall portion 53 and the third wall portion 73 as viewed from the first end 12*a* side. The fourth wall portion 74 is arranged at a position closer to the drive shaft 12 than the second movable contact 10*b*. That is, the second movable contact 10*b* is arranged between the fourth wall portion 54 and the fourth wall portion 74 as viewed from the first end 12*a* side.

The rotation preventing portion 7*e* restricts rotation of the holder 30 around the drive shaft 12. The rotation preventing portion 7*e* projects from the base portion 7*a* toward the movable contact piece 10. The rotation preventing portion 7*e* is arranged so as to contact the holder 30 at a position closer to the second end 12*b* side than the movable contact piece 10 and closer to the drive shaft 12 than the movable contacts 10*a* and 10*b*. In the present embodiment, the rotation preventing portion 7*e* is composed of the third wall portion 73 and the fourth wall portion 74. Therefore, the rotation preventing portion 7*e* extends parallel to the lateral direction of the movable contact piece 10.

Figure 5:
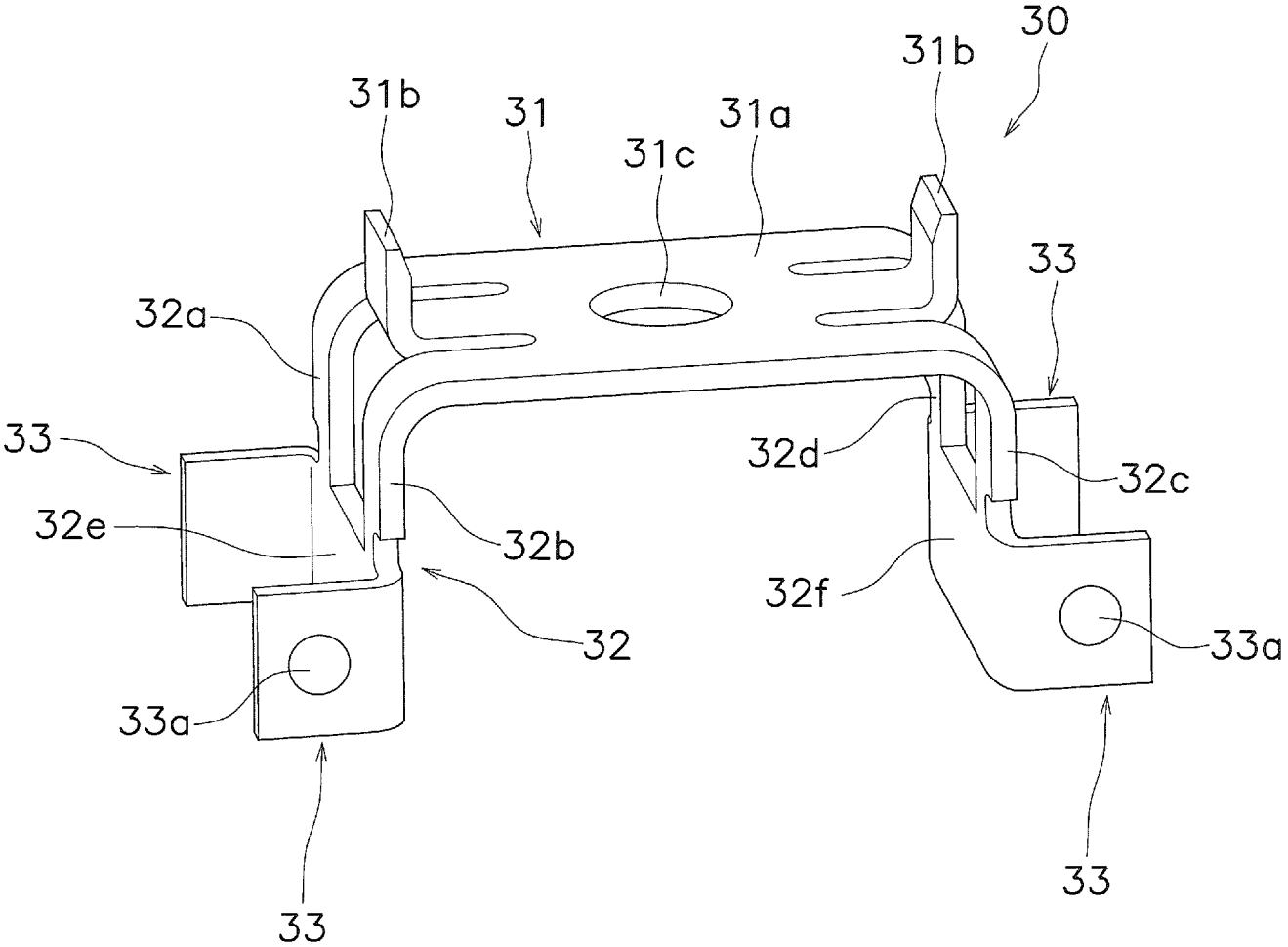
FIG. 5 is a perspective view of a holder.

Next, the details of the holder 30 will be described with reference to FIGS. 3 to 5. The holder 30 includes a holding portion 31, a leg portion 32, and a plurality of contact portions 33.

The holding portion 31 includes a pedestal portion 31*a*, a pair of clamping portions 31*b*, and a through hole 31*c*. The pedestal portion 31*a* extends in the lateral direction of the movable contact piece 10. The pedestal portion 31*a* is arranged near the center in the longitudinal direction of the movable contact piece 10, and the movable contact piece 10 is placed on the first end 12*a* side of the pedestal portion 31*a*. The pedestal portion 31*a* is in contact with the contact spring 14 on the second end 12*b* side, and is biased in the contact direction by the contact spring 14.

The pair of clamping portions 31*b* clamps the lateral side portions of the movable contact piece 10 and holds the movable contact piece 10 on the pedestal portion 31*a* so as to rotate integrally with the movable contact piece 10. The pair of clamping portions 31*b* extend from the pedestal portion 31*a* toward the first end 12*a* side. The pair of clamping portions 31*b* is formed by bending a part of the leg portion 32 toward the first end 12*a* side.

The through hole 31*c* is a circular hole into which the first end 12*a* of the drive shaft 12 is inserted, and is formed at the center of the pedestal portion 31*a* so as to penetrate therethrough in the up-down direction.

The leg portion 32 extends from both ends of the pedestal portion 31*a* in the lateral direction of the movable contact piece 10 toward the first end side. Specifically, the leg portion 32 includes first to fourth leg portions 32*a* to 32*d*. Each of the first to fourth leg portions 32*a* to 32*d* extends from the four corners of the pedestal portion 31*a* toward the second end 12*b*. The first leg portion 32*a* and the second leg portion 32*b* are arranged apart from each other in the left-right direction. The third leg portion 32*c* and the fourth leg portion 32*d* are arranged apart from each other in the left-right direction. The pair of clamping portions 31*b* is arranged between the first leg portion 32*a* and the second leg portion 32*b*, and between the third leg portion 32*c* and the fourth leg portion 32*d*.

A first connection portion 32*e* connects the first leg portion 32*a* and the second leg portion 32*b*. Specifically, the first connection portion 32*e* extends in the left-right direction and connects the lower end portion of the first leg portion 32*a* and the lower end portion of the second leg portion 32*b*. A second connection portion 32*f* connects the third leg portion 32*c* and the fourth leg portion 32*d*. Specifically, the second connection portion 32*f* extends in the left-right direction and connects the lower end portion of the third leg portion 32*c* and the lower end portion of the fourth leg portion 32*d*.

The plurality of contact portions 33 are arranged inside the inner wall portion 7*d* and is configured to contact the rotation preventing portion 7*e*. The plurality of contact portions 33 are arranged so as to face the rotation preventing portion 7*e* in the longitudinal direction of the movable contact piece 10. The plurality of contact portions 33 extends parallel to the lateral direction of the movable contact piece 10. Specifically, the plurality of contact portions 33 extend in the lateral direction of the movable contact piece 10 from the lower end portion of each of the first to fourth leg portions 32*a* to 32*d*. In the present embodiment, the plurality of contact portions 33 extend in a direction away from the lateral center of the movable contact piece 10 as viewed from the first end 12*a* side. As illustrated in FIG. 3, the plurality of contact portions 33 are arranged without overlapping the movable contact piece 10 in the moving direction of the movable contact piece 10.

The plurality of contact portions 33 each includes a protruding portion 33*a* protruding in a hemispherical shape toward the inner wall portion 7*d*. In the present embodiment, when the holder 30 attempts to rotate around the axis of the drive shaft 12, the protruding portions 33*a* come into contact with the rotation preventing portion 7*e*, and the rotation of the holder 30 around the drive shaft 12 is restricted. The protruding portions 33*a* of the plurality of contact portions 33 can contact the inner side surface of the third wall portion 73 and the inner side surface of the fourth wall portion 74.

The height of each of the third wall portion 73 and the fourth wall portion 74 from the base portion 7*a* is set at a height such that the plurality of contact portions 33 can contact the third wall portion 73 and the third wall portion 73 when the holder 30 is moved in the contact direction by driving the drive device 4.

In the relay 100 configured as described above, the rotation preventing portion 7*e* is arranged so as to contact the holder 30 at a position closer to the second end 12*b* side than the movable contact piece 10 and closer to the drive shaft 12 than the movable contacts 10*a*, 10*b*. Thereby, the arc extension space 5*c* can be secured on the second end 12*b* side of the drive shaft 12 in the movable contact piece 10, so that the arc extension space 5*c* can be efficiently secured. As a result, the relay can be easily downsized. Further, the contact case 5 can be more easily downsized as compared with the case where the rotation preventing portion 7*e* is provided so as to project from the inner wall of the contact case 5. Further, since the rotation preventing portion 7*e* is provided on the inner member 7 that is provided separately from the contact case 5, the degree of freedom of arrangement within the contact case 5 is improved.

Further, since the plurality of contact portions 33 and the rotation preventing portion 7*e* are arranged to face each other in the longitudinal direction of the movable contact piece 10, a distance between the contact portions 33 can be made larger than that in the case where the contact portions 33 and the rotation preventing portion 7*e* are arranged to face each other are in the lateral direction of the movable contact piece 10. Specifically, for example, when the plurality of contact portions 33 is brought into contact with the first wall portion 71 and the second wall portion 72, the lengths of the first wall portion 71 and the second wall portion 72 in the left-right direction are shorter than the lengths of third wall portion 73 and the fourth wall portion 74 in the front-back direction. For this reason, the distance between the contact portions 33 contacting the first wall portion 71 and the contact portions 33 contacting the second wall portion 72 becomes narrower. That is, when the plurality of contact portions 33 is brought into contact with the third wall portion 73 and the fourth wall portion 74, the rotation angle of the holder 30 around the drive shaft 12 can be suppressed as compared with the case where the plurality of contact portions 33 is brought into contact with the first wall portion 71 and the second wall portion 72.

While the embodiment of the electromagnetic relay according to one aspect of the present invention has been described, the present invention should not be construed as being limited thereto, and various types of modifications may be made without departing from the spirit or scope of the general inventive concept of the invention.

In the above-described embodiment, the rotation preventing portion 7*e* is configured by the third wall portion 73 and the fourth wall portion 74, but the structure of the rotation preventing portion 7*e* is not limited to the above embodiment. The third wall portion 73 and the fourth wall portion 74 may be formed only on a part facing the plurality of contact portions 33. Further, the rotation preventing portion 7*e* and the plurality of contact portions 33 may be arranged so as to face each other in the lateral direction of the movable contact piece 10. That is, the rotation preventing portion 7*e* may be configured by the first wall portion 71 and the second wall portion 72.

The structure of the holder 30 is not limited to the above-described embodiment. For example, the protruding portion 33*a* of the plurality of contact portions 33 may be omitted. The plurality of contact portions 33 may overlap the movable contact piece 10 in the moving direction of the movable contact piece 10.

The configuration of the magnetic field generation member 6 is not limited to the above-described embodiment. Permanent magnets may be arranged near the movable contacts 10*a*, 10*b* so as to generate the magnetic flux in the left-right direction.

Figure 6:
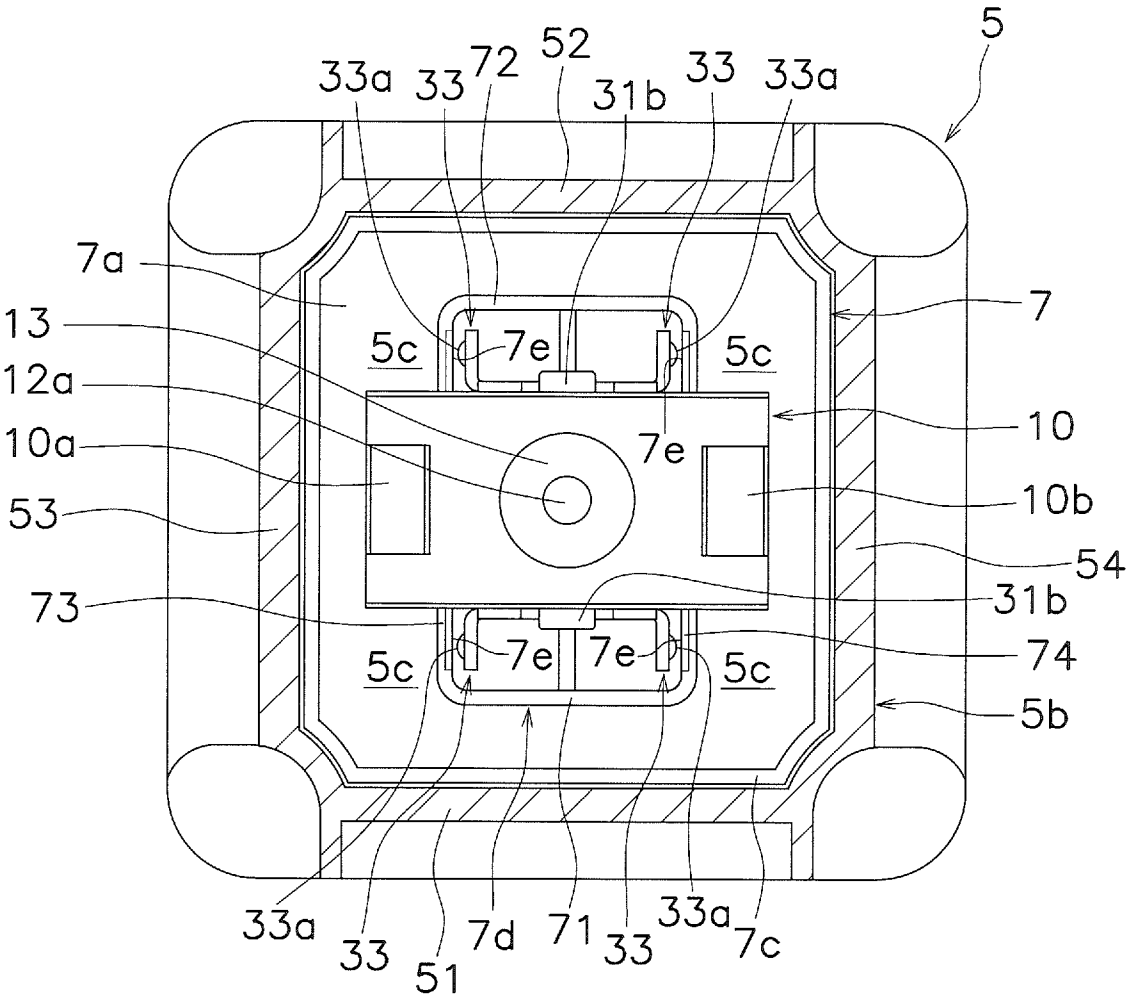
FIG. 6 is a view showing a modified example of an inner case.

In the above-described embodiment, the entire inner member 7 is made of an insulating material, but as illustrated in FIG. 6, the rotation preventing portion 7*e* may be made of a metal member. For example, a metal member may be integrally molded with the inner member 7 by insert molding, or a metal piece may be inserted into the inner member 7. The holder 30 is made of metal. In this case, since the plurality of contact portions 33 and the rotation preventing portion 7*e* are made of a metal member, it is possible to prevent the rotation preventing portion 7*e* from being scraped as compared with the case where the rotation preventing portion 7*e* is formed of resin.

The invention claimed is:

1. A relay comprising:

a fixed terminal including a fixed contact;

a movable contact piece including a movable contact arranged to face the fixed contact, the movable contact piece being configured to move in a moving direction including a first direction in which the movable contact comes into contact with the fixed contact and a second direction in which the movable contact separates from the fixed contact;

a holder that holds the movable contact piece;

a drive shaft including a first end and a second end opposite to the first end, the drive shaft extending in the moving direction of the movable contact piece, the drive shaft being connected to the holder on a side close to the first end of the drive shaft;

a contact case that accommodates the fixed contact, the movable contact piece, and the holder;

a magnetic field generation member arranged around the contact case, the magnetic field generation member being configured to generate a magnetic field in which an arc generated between the fixed contact and the movable contact extends in a lateral direction of the movable contact piece; and an inner member that is a separate body from the contact case and that includes a rotation preventing portion for restricting rotation of the holder around the drive shaft, the rotation preventing portion being arranged so as to contact the holder at a position closer to the second end of the drive shaft than the movable contact piece and closer to the drive shaft than the movable contact, wherein the holder includes a plurality of contact portions configured to contact the rotation preventing portion, and the plurality of contact portions are arranged to face the rotation preventing portion in a longitudinal direction orthogonal to the lateral direction of the movable contact piece.

2. The relay according to claim 1, wherein the contact case has an opening that opens toward the second end of the drive shaft, the inner member further includes a base portion arranged to cover the opening of the contact case, and the rotation preventing portion projects from the base portion toward the movable contact piece.

3. The relay according to claim 2, wherein the inner member further includes a tubular portion extending from the base portion in the moving direction and into which the drive shaft is inserted.

4. The relay according to claim 1, wherein the plurality of contact portions and the rotation preventing portion extend parallel to the lateral direction of the movable contact piece.

5. The relay according to claim 4, wherein the plurality of contact portions are arranged without overlapping the movable contact piece in the moving direction of the movable contact piece.

6. The relay according to claim 1, wherein the holder includes a pedestal portion on which the movable contact piece is placed, a leg portion extending from both ends of the pedestal portion in the lateral direction of the movable contact piece toward the second end of the drive shaft, and a pair of clamping portions clamping the movable contact piece, the pair of the clamping portions being formed by bending a part of the leg portion toward the first end of the drive shaft.

7. The relay according to claim 1, wherein at least a part of the inner member is formed of an insulating material.

8. The relay according to claim 1, wherein the plurality of contact portions and the rotation preventing portion are made of a metal member.

* * * * *